US009279291B2

(12) United States Patent
Fang et al.

(10) Patent No.: US 9,279,291 B2
(45) Date of Patent: Mar. 8, 2016

(54) DIAMOND ENHANCED DRILLING INSERT WITH HIGH IMPACT RESISTANCE

(71) Applicant: Smith International, Inc., Houston, TX (US)

(72) Inventors: Yi Fang, Orem, UT (US); Scott L. Horman, Provo, UT (US)

(73) Assignee: Smith International, Inc., Houston, TX (US)

( * ) Notice: Subject to any disclaimer, the term of this patent is extended or adjusted under 35 U.S.C. 154(b) by 344 days.

(21) Appl. No.: 13/717,865

(22) Filed: Dec. 18, 2012

(65) Prior Publication Data

US 2013/0168155 A1 Jul. 4, 2013

Related U.S. Application Data

(60) Provisional application No. 61/581,757, filed on Dec. 30, 2011.

(51) Int. Cl.

| | |
|---|---|
| ***E21B 10/46*** | (2006.01) |
| ***E21B 10/55*** | (2006.01) |
| ***E21B 10/567*** | (2006.01) |
| ***E21B 10/573*** | (2006.01) |

(52) U.S. Cl.
CPC ..... *E21B 10/46* (2013.01); *E21B 10/5673* (2013.01); *E21B 10/5735* (2013.01)

(58) Field of Classification Search
CPC ... E21B 10/46; E21B 2010/545; E21B 10/55; E21B 2010/561; E21B 10/567; B01J 3/06; B23B 27/20
See application file for complete search history.

(56) References Cited

U.S. PATENT DOCUMENTS

| | | | | |
|---|---|---|---|---|
| 4,525,178 | A | 6/1985 | Hall | |
| 4,604,106 | A | 8/1986 | Hall | |
| 4,694,918 | A | 9/1987 | Hall | |
| 4,725,345 | A | 2/1988 | Sakamoto et al. | |
| 5,137,398 | A * | 8/1992 | Omori et al. | 408/145 |
| 5,370,195 | A | 12/1994 | Keshavan et al. | |
| 5,783,295 | A | 7/1998 | Barnett et al. | |
| 6,227,318 | B1 * | 5/2001 | Siracki | 175/430 |
| 6,290,008 | B1 | 9/2001 | Portwood et al. | |
| 6,651,757 | B2 | 11/2003 | Belnap et al. | |

(Continued)

FOREIGN PATENT DOCUMENTS

| | | | |
|---|---|---|---|
| CA | 2451825 | A1 | 7/2004 |
| CN | 2906032 | Y | 5/2007 |

(Continued)

OTHER PUBLICATIONS

Lux et al., "Diamond as a Wear-Resistant Coating", Philosophical Transactions: Physical Sciences and Engineering, vol. 342(1664), 1993, pp. 297-311.

(Continued)

*Primary Examiner* — Cathleen Hutchins

(57) ABSTRACT

An insert for a drill bit may include a substrate; a working layer of polycrystalline diamond material on the uppermost end of the insert, wherein the polycrystalline diamond material includes a plurality of interconnected diamond grains; and a binder material; and an inner transition layer between the working layer and the substrate, wherein the inner transition layer is adjacent to the substrate; wherein the inner transition layer has a hardness that is at least 500 HV greater than the hardness of the substrate.

22 Claims, 8 Drawing Sheets

(56) References Cited

U.S. PATENT DOCUMENTS

| | | | |
|---|---|---|---|
| 7,166,371 | B2 | 1/2007 | Lakhotkin et al. |
| 8,573,330 | B2 | 11/2013 | Mourik et al. |
| 8,579,053 | B2 | 11/2013 | Bellin et al. |
| 8,647,562 | B2 | 2/2014 | Dourfaye et al. |
| 8,720,612 | B2 | 5/2014 | Corbett et al. |
| 2009/0202790 | A1 | 8/2009 | Eerden et al. |
| 2009/0308663 | A1 | 12/2009 | Patel et al. |
| 2011/0031032 | A1 | 2/2011 | Mourik et al. |
| 2011/0031033 | A1 | 2/2011 | Mourik et al. |
| 2011/0031037 | A1 | 2/2011 | Bellin et al. |
| 2011/0052934 | A1 | 3/2011 | Sugimoto et al. |

FOREIGN PATENT DOCUMENTS

| | | | |
|---|---|---|---|
| WO | 2008051588 | A2 | 5/2008 |
| WO | 2011017582 | A2 | 2/2011 |

OTHER PUBLICATIONS

Jaffar et al., "New PDC Technology Significantly Improves Performance in Drilling Deep Khuff Wells for a Major Operator in Abu Dhabi", SPE/IADC 96792, SPE/IADC Middle East Drilling Technology Conference & Exhibition held in Dubai, U.A.E., Sep. 12-15, 2005; 11 pages.

Mohamed et al., "New PDC Technologies Utilized to Improve Performance in Deep Khuff Gas Wells for Offshore Operator in Abu Dhabi", SPE/IADC 125709, SPE/IADC Middle East Drilling Technology Conference & Exhibition held in Manama, Bahrain, Oct. 26-28, 2009; 9 pages.

Examiners Report relating to Canadian Patent Application No. 2799759 dated Apr. 9, 2014; 3 pages.

Patent Examination Report No. 1 relating to Australian Patent Application 2012268807 dated Mar. 21, 2014; 6 pages.

Niotsu et al., "Sintering of diamond with cobalt", Mater.Res.Bull., vol. 12, 1977, pp. 1079-1085.

Akaishi et al., "Synthesis of sintered diamond with a high electrical resistivity and hardness", J. Am. Ceram. Soc., vol. 70, No. 10, 1987, pp. C-237-C-239.

Uehara et al., "High pressure sintering of diamond of cobalt infiltration", Int. J. Ref. Mater Hard Mater, Dec. 1988, pp. 219-223.

Katzman et al., "Sintered diamond compacts with a cobalt binder", Science, vol. 172, 1971, pp. 1132-1134.

Nazarchuk et al., "The diamond-tungsten carbide polycrystalline composite material", J. Superhard Mater., vol. 33, 2011, pp. 1-12.

Belnap et al., "Homogeneous and structured PCT/WC-Co materials for drilling", Diamond & Related Materials, vol. 13, 2004, pp. 1914-22.

Caetano et al., "Liquid Phase Diamond Composite Sintering", Conanet/SAM-2008 Proceeding, 2008, 5 pages.

Akaishi et al., "Sintering behavior of diamond-cobalt system at high temperature and pressure", J. Mater. Sci., vol. 17, 1982, pp. 193-198.

Popkin et al., "Amborite—A remarkable new cutting material from De Beers", Industrial Diamond Review, Jun. 1980, pp. 202-206.

Jia et al., "Microstruture, hardness and toughness of nanostructured and conventional WC-Co composites", Nanostructured Materials, vol. 10, 1998, pp. 875-891.

Kennedy et al., "The equiilibrium boundary between graphite and diamond", Journal of Geophysical Research, vol. 31, No. 14, 1976, pp. 2467-2470.

Loshak et al., "The Effect of the Indentation Load on the Results of measuring Hardness of Superhard materials", Jounal of Super Hard Materials, vol. 34, No. 5, 2012, pp. 305-307.

Besson et al., "On the Cutting Edge", Oilfield Review, Autumn 2000, pp. 36-57.

Extended European Search Report issued in related EP application 12198870.3 on Dec. 2, 2015, 8 pages.

* cited by examiner

DIAMOND ENHANCED DRILLING INSERT WITH HIGH IMPACT RESISTANCE

RELATED APPLICATIONS

This application claims the benefit of U.S. Provisional Application Ser. No. 61/581,757, filed on Dec. 30, 2011, which is incorporated by reference herein in its entirety.

BACKGROUND

1. Field of the Invention

Embodiments disclosed herein relate generally to diamond enhanced inserts.

2. Background Art

An earth-boring drill bit is typically mounted on the lower end of a drill string and is rotated by rotating the drill string at the surface or by actuation of downhole motors or turbines, or by both methods. When weight is applied to the drill string, the rotating drill bit engages the earth formation and proceeds to form a borehole along a predetermined path toward a target zone.

There are several types of drill bits, including roller cone bits, hammer bits, and drag bits. The term "drag bits" (also referred to as "fixed cutter drill bits") refers to those rotary drill bits with no moving elements. Fixed cutter bits include those having cutting elements attached to the bit body, which predominantly cut the formation by a shearing action. Cutting elements used on fixed cutter bits may include polycrystalline diamond compacts (PDCs), diamond grit impregnated inserts ("grit hot-pressed inserts" (GHIs), or natural diamond. Roller cone rock bits include a bit body adapted to be coupled to a rotatable drill string and include at least one "cone" that is rotatably mounted to a cantilevered shaft or journal as frequently referred to in the art. Each roller cone in turn supports a plurality of cutting elements that cut and/or crush the wall or floor of the borehole and thus advance the bit. The cutting elements, either inserts or milled teeth, contact with the formation during drilling to crush, gouge, and scrape rock at the bottom of a hole being drilled. Hammer bits are typically include a one piece body with having crown. The crown includes inserts pressed therein for being cyclically "hammered" and rotated against the earth formation being drilled.

Depending on the type and location of the cutting elements on a drill bit, the cutting elements perform different cutting functions, and as a result, also experience different loading conditions during use. Two kinds of wear-resistant inserts have been developed for use as cutting elements on drill bits: tungsten carbide inserts (TCIs) and polycrystalline diamond enhanced inserts (DEIs). Tungsten carbide inserts are typically formed of cemented tungsten carbide (also known as sintered tungsten carbide): tungsten carbide particles dispersed in a cobalt binder matrix. A polycrystalline diamond enhanced insert typically includes a cemented tungsten carbide body as a substrate and a layer of polycrystalline diamond ("PCD") directly bonded to the tungsten carbide substrate on the top portion of the insert. A working layer formed of a PCD material can provide improved wear resistance, as compared to the softer, tougher tungsten carbide inserts.

The layer(s) of PCD conventionally include diamond and a metal in an amount of up to about 30 percent by weight of the layer to facilitate diamond intercrystalline bonding and bonding of the layers to each other and to the underlying substrate. Metals employed in PCD are often selected from cobalt, iron, or nickel and/or mixtures or alloys thereof and can include metals such as manganese, tantalum, chromium and/or mixtures or alloys thereof. However, while higher metal content typically increases the toughness of the resulting PCD material, higher metal content also decreases the PCD material hardness, thus limiting the flexibility of being able to provide PCD coatings having desired levels of both hardness and toughness. Additionally, when variables are selected to increase the hardness of the PCD material, typically brittleness also increases, thereby reducing the toughness of the PCD material.

Although the polycrystalline diamond layer is extremely hard and wear resistant, a polycrystalline diamond enhanced insert may still fail during normal operation. Failure typically takes one of three common forms, namely wear, fatigue, and impact cracking. The wear mechanism occurs due to the relative sliding of the PCD relative to the earth formation, and its prominence as a failure mode is related to the abrasiveness of the formation, as well as other factors such as formation hardness or strength, and the amount of relative sliding involved during contact with the formation. Excessively high contact stresses and high temperatures, along with a very hostile downhole environment, also tend to cause severe wear to the diamond layer. The fatigue mechanism involves the progressive propagation of a surface crack, initiated on the PCD layer, into the material below the PCD layer until the crack length is sufficient for spalling or chipping. Lastly, the impact mechanism involves the sudden propagation of a surface crack or internal flaw initiated on the PCD layer, into the material below the PCD layer until the crack length is sufficient for spalling, chipping, or catastrophic failure of the enhanced insert.

External loads due to contact tend to cause failures such as fracture, spalling, and chipping of the diamond layer. Internal stresses, for example thermal residual stresses resulting from the manufacturing process, tend to cause delamination between the diamond layer and the substrate or the transition layer, either by cracks initiating along the interface and propagating outward, or by cracks initiating in the diamond layer surface and propagating catastrophically along the interface.

The primary approach used to address the delamination problem in convex cutting elements is the addition of transition layers made of materials with thermal and elastic properties located between the ultrahard material layer and the substrate, applied over the entire substrate protrusion surface. These transition layers have the effect of reducing the residual stresses at the interface and thus improving the resistance of the inserts to delamination.

Transition layers have significantly reduced the magnitude of detrimental residual stresses and correspondingly increased durability of inserts in application. Nevertheless, basic failure modes still remain. These failure modes involve complex combinations of three mechanisms, including wear of the PCD, surface initiated fatigue crack growth, and impact-initiated failure.

It is, therefore, desirable that an insert structure be constructed that provides desired PCD properties of hardness and wear resistance with improved properties of fracture toughness and chipping resistance, as compared to conventional PCD materials and insert structures, for use in aggressive cutting and/or drilling applications.

SUMMARY OF INVENTION

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to an insert for a drill bit that includes a substrate; a working layer of polycrystalline diamond material on the uppermost end of the insert, wherein the polycrystalline diamond material includes a plurality of interconnected diamond grains; and a binder material; and an inner transition layer between the working layer and the substrate, wherein the inner transition layer is adjacent to the substrate; wherein the inner transition layer has a hardness that is at least 500 HV greater than the hardness of the substrate.

In another aspect, embodiments disclosed herein relate to a-n insert for a drill bit that includes a substrate; a working layer of polycrystalline diamond material on the uppermost end of the insert, wherein the polycrystalline diamond material includes: a plurality of interconnected diamond grains; and a binder material; and an outer transition layer between the working layer and the substrate, wherein the outer transition layer is adjacent to the working layer; wherein the working layer has a hardness greater than or equal to 4000 HV; and wherein the outer transition layer has a hardness that is less than the working layer hardness by less than 1500 HV.

In yet another aspect, embodiments disclosed herein relate to an insert for a drill bit that includes a substrate; a working layer of polycrystalline diamond material on the uppermost end of the insert, wherein the polycrystalline diamond material includes: a plurality of interconnected diamond grains; and a binder material; and an outer transition layer between the working layer and the substrate, wherein the outer transition layer is adjacent to the working layer; wherein the outer transition layer has a hardness that is less than the working layer hardness by less than 35%.

In another aspect, embodiments disclosed herein relate to a drill bit that includes a bit body and at least one insert that includes a substrate; a working layer of polycrystalline diamond material on the uppermost end of the insert, wherein the polycrystalline diamond material includes a plurality of interconnected diamond grains; and a binder material; and an inner transition layer between the working layer and the substrate, wherein the inner transition layer is adjacent to the substrate; wherein the inner transition layer has a hardness that is at least 500 HV greater than the hardness of the substrate.

In another aspect, embodiments disclosed herein relate to a drill bit that includes a bit body and at least one insert that includes a substrate; a working layer of polycrystalline diamond material on the uppermost end of the insert, wherein the polycrystalline diamond material includes: a plurality of interconnected diamond grains; and a binder material; and an outer transition layer between the working layer and the substrate, wherein the outer transition layer is adjacent to the working layer; wherein the working layer has a hardness greater than or equal to 4000 HV; and wherein the outer transition layer has a hardness that is less than the working layer hardness by less than 1500 HV.

In yet another aspect, embodiments disclosed herein relate to a drill bit that includes a bit body and at least one insert that includes a substrate; a working layer of polycrystalline diamond material on the uppermost end of the insert, wherein the polycrystalline diamond material includes: a plurality of interconnected diamond grains; and a binder material; and an outer transition layer between the working layer and the substrate, wherein the outer transition layer is adjacent to the working layer; wherein the outer transition layer has a hardness that is less than the working layer hardness by less than 35%.

Other aspects and advantages of the invention will be apparent from the following description and the appended claims.

BRIEF DESCRIPTION OF DRAWINGS

Embodiments of the present disclosure are described with reference to the following figures.

DETAILED DESCRIPTION

Embodiments disclosed herein relate generally to diamond enhanced inserts having increased impact resistance. In particular, inserts of the present disclosure may have a substrate, a working layer of polycrystalline diamond ("PCD") material forming the working surface of the insert, and at least one transition layer there between. The mechanical properties of the at least one transition layer are optimized to improve both impact resistance as well as improved static load carrying capability. According to embodiments disclosed herein, the hardness of the at least one transition layer may be engineered according to the hardness properties of the working layer and/or the substrate.

Figure 1:
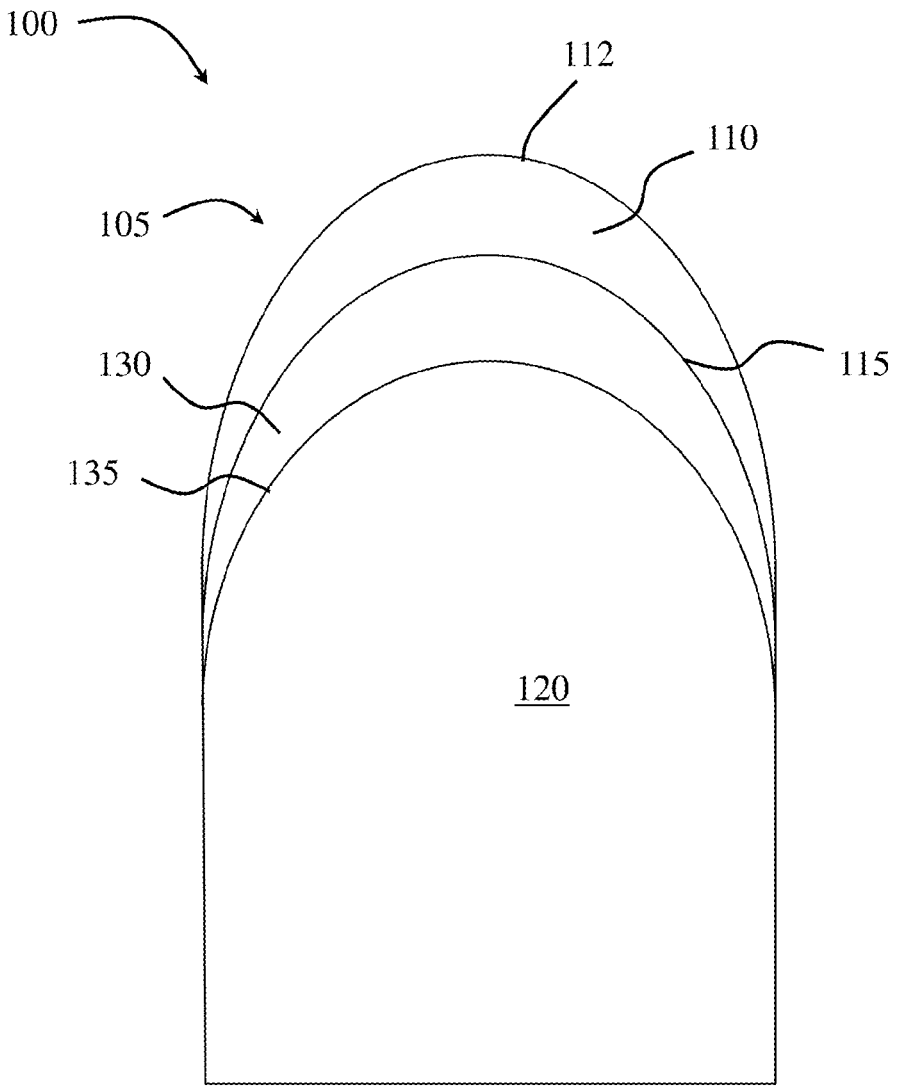
FIG. 1 shows a cross-sectional view of an insert according to embodiments of the present disclosure.

For example, referring to FIG. 1, an insert 100 according to the present disclosure has a working layer 110 made of PCD material, a substrate 120, and at least one transition layer 130 therebetween. The working layer 110 is disposed at the uppermost end 105 of the insert 100 and forms the working or cutting surface 112 of the insert 100. As shown, the insert 100 has one transition layer 130 between and adjacent to both the working layer 110 and the substrate 120, wherein a working layer/transition layer interface 115 is formed between the working layer 110 and the transition layer 130, and a transition layer/substrate interface 135 is formed between the transition layer 130 and the substrate 120. However, according to other embodiments of the present disclosure, an insert may have more than one transition layer (described below). Further, in accordance with embodiments of the present disclosure, the hardness values of the working layer, the at least one transition layer, and/or the substrate may be designed to be within optimized hardness ranges described below so that the insert possess both high impact resistance as well as improved static load carrying capability.

PCD Working Layer

As used herein, "polycrystalline diamond" or "PCD" refers to a plurality of interconnected diamond crystals having interstitial spaces there between in which a metal component (such as a metal catalyst) may reside. The interconnected diamond crystal structure of PCD includes direct diamond-to-diamond bonding, and may often be referred to as forming a lattice or matrix structure. Particularly, a metal catalyst material, such as cobalt, may be used to promote re-crystallization of the diamond crystals, wherein the diamond grains are regrown together to form the lattice structure, thus leaving particles of the remaining metal catalyst within the interstitial spaces of the diamond lattice.

Diamond grains useful for forming PCD material of the present disclosure may include synthetic and/or natural diamond grains having an average grain size ranging from submicrometer to 100 microns according to some embodiments, and ranging from about 1 to 80 microns in other embodiments. In other embodiments, the average diamond grain size used to form the polycrystalline diamond working layer may broadly range from about 2 to 30 microns in one embodiment, less than about 20 microns in another embodiment, and less than about 15 microns in yet another embodiment. It is also contemplated that other particular narrow ranges may be selected within the broad range, depending on the particular application and desired properties of the layer. The diamond grains may have a mono- or multi-modal size distribution.

PCD material may be formed using a high pressure/high temperature ("HPHT") process, wherein the diamond grains are sintered together in the presence of a metal catalyst material, such as one or more elements from Group VIII of the Periodic table. HPHT processing is known in the art, and may use pressures of greater than 5,000 MPa and temperatures ranging from 1,300° C. to 1,500° C., for example. Examples of HPHT processes can be found, for example, in U.S. Pat. Nos. 4,694,918; 5,370,195; and 4,525,178. Briefly to form the PCD material, an unsintered mass of diamond crystalline particles and a metal catalyst is placed within a metal enclosure of the reaction cell of a HPHT apparatus. The reaction cell is then placed under processing conditions sufficient to cause intercrystalline bonding between the diamond particles. Alternatively, a catalyst may be provided by infiltration during HPHT processing from the insert substrate or an adjacent transition layer, for example.

In particular, diamond to diamond bonding is catalyzed by the metal catalyst material, whereby the metal remains in the interstitial regions between the bonded together diamond particles. Thus, the metal particles added to the diamond grains may function as a catalyst and/or binder, depending on the exposure to diamond particles that can be catalyzed as well as the temperature and pressure conditions. For the purposes of this application, when the metallic component is referred to as a metal binder, it does not necessarily mean that no catalyzing function is also being performed, and when the metallic component is referred to as a metal catalyst, it does not necessarily mean that no binding function is also being performed.

PCD material of the present disclosure may be designed to have a desired hardness by, for example, by changing the relative amounts of diamond grains and binder material and/or by changing the diamond grain sizes, the ratio of the binder metal and carbide particles content, and the relative dispersion between secondary phases (including both binder metal and carbide particles) and diamond particles. For example, PCD material may have at least about 80 percent by volume diamond, with the remaining balance of the interstitial regions between the diamond grains occupied by the binder material. In other embodiments, such diamond content may comprise at least 85 percent by volume of the formed PCD material, and at least 90 percent by volume in yet another embodiment. Further, PCD material may have higher diamond densities, such as 95 percent by volume or greater, which is frequently referred to in the art as "high density" PCD. Generally, PCD may have a hardness in the range of about 3,000 HV to 4,000 HV, or greater. PCD having a composition of relatively higher amounts of binder material may have a hardness within the lower part of the range, while PCD having a composition of relatively higher diamond densities may have a hardness within the upper part of the range. Additionally, the hardness of the PCD material may be varied by changing the average diamond grain size. For example, PCD material having an average diamond grain size of greater than 10 microns (often referred to as a "coarse" grain size) may have a relatively higher hardness than a PCD material having a smaller average grain size. However, various combinations of diamond content and grain size may be used to design PCD material having various hardness values.

Insert Transition Layer(s)

As discussed above, the inserts of the present disclosure may have at least one transition layer. The at least one transition layer may include composites of diamond grains, a metal binder, and metal carbide or carbonitride particles, such as carbide or carbonitride particles of tungsten, tantalum, titanium, chromium, molybdenum, vanadium, niobium, hafnium, zirconium, or mixtures thereof. The relative amounts of diamond and metal carbide or carbonitride particles may indicate the extent of diamond-to-diamond bonding within the layer. Further, each of the relative amounts of diamond, metal carbide or carbonitride particles, and binder material, the grain sizes of the diamond and metal carbide or carbonitride material, and the type of metal carbide or carbonitride particles may indicate the hardness of the transition layer. For example, the at least one transition layer may have a lesser amount of diamond content than the working layer of an insert to form a decreasing, non-continuous gradient of diamond between the working layer and the substrate, and may have an increasing amount of carbide/carbonitride content from the working layer to the substrate to form an increasing, non-continuous gradient of carbide/carbonitride between the working layer and the substrate. Transition layers having a relatively higher diamond and/or carbide content and relatively lower binder content may have a higher hardness than transition layers having relatively lower diamond and/or carbide content and relatively higher binder content.

In addition to or alternative to the use of altering diamond and/or carbide content in the at least one transition layer to engineer the transition layer hardness, diamond grain size and/or carbide grain size may be altered to design a transition layer with a desired hardness. For example, as mentioned above, larger sized diamond grains may be used to form a transition layer with improved hardness. For example, a diamond mix containing 37 wt % 17 micron diamond grains would have similar hardness (~3200 HV) as a diamond mix containing 42 wt % 6 micron diamond grains. However, one skilled in the art may appreciate that many material design criteria must be considered when forming a composite material having a desired hardness. Thus, while some general trends relating material content to the material hardness have been mentioned, various combinations of material design may be used to design a composite material (such as used to form the at least one transition layer) having a desired hardness.

Insert Substrate

The substrate of inserts according to the present disclosure may be made of a metallic carbide material, such as a cemented or sintered carbide of one of the Group IVB, VB, and VIB metals, e.g., tungsten carbide, tantalum carbide, or titanium carbide, which are generally pressed or sintered in the presence of a binder, such as cobalt, nickel, iron, alloys thereof, or mixtures thereof. Particularly, the metal carbide grains are supported within the metallic binder matrix. Such metal carbide composites are often referred to as cermets. A typical insert substrate may be made of a tungsten carbide cobalt composite. However, it is well known that various metal carbide compositions and binders may be used, in addition to tungsten carbide and cobalt. Thus, references to the use of tungsten carbide and cobalt are for illustrative purposes only, and no limitation on the type of substrate or binder used is intended.

Optimized Hardness Properties

Transition layers between a diamond working layer and a carbide substrate have often been used to form diamond enhanced inserts for drill bits. Typically, such transition layers are made of diamond and carbide mixtures to create a compositional gradient between the working layer and the carbide substrate. However, manufacturing inserts having multiple composite transition layers to form compositional gradients is often difficult. Further, while the use of transition layers may improve the fracture resistance and survivability of such inserts during drilling, the mere concept of transition layers does not necessarily guarantee a performance improvement in the inserts. Rather, the use of composite transition layers may reduce insert life if the transition layer composition is not properly engineered. However, inventors of the present disclosure have found a way to improve the performance of multi-layer diamond enhanced inserts through consideration of the load carrying capability of a system of successive layers and by controlling the hardness properties of each layer. By optimizing the mechanical properties of such multi-layered diamond enhanced inserts, particularly the relative hardness of the transition layers with respect to the diamond working layer and/or to the substrate, the transition layer(s) may provide significant support to the working layer and improve the survivability rate of the insert during drilling. Additionally, by forming inserts according to the optimization principles of the present disclosure, the implementation of transition layer(s) may be achieved without over-engineering. For example, some prior art diamond enhanced inserts may have multiple transition layers such that a substantially continuously changing transition is formed between the working surface and the substrate of the insert. However, such inserts may be difficult to manufacture correctly, as well as more expensive to produce.

Figure 2:
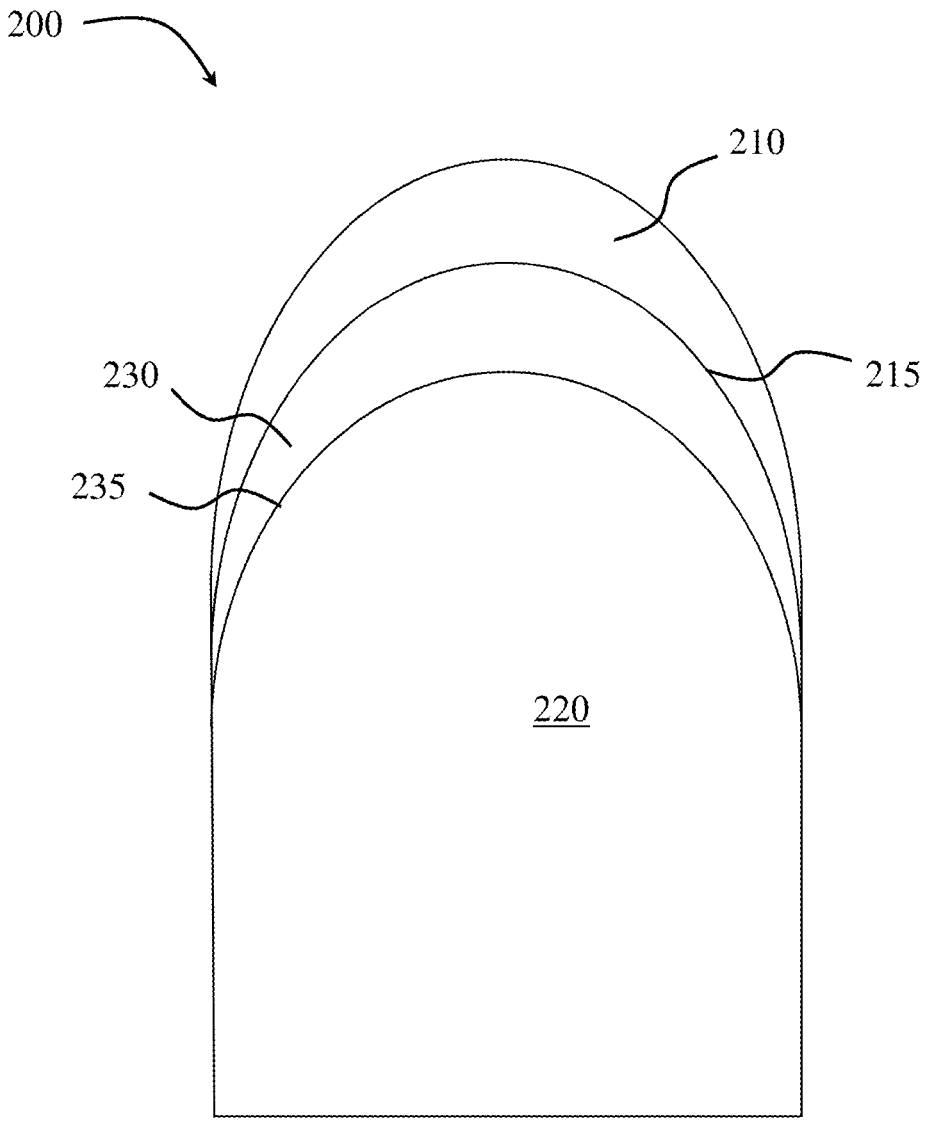
FIG. 2 shows a cross-sectional view of an insert according to embodiments of the present disclosure.

According to embodiments of the present disclosure, an insert for a drill bit may be formed having a substrate, a working layer of polycrystalline diamond material on the uppermost end of the insert, and at least one transition layer between the substrate and the working layer, wherein the hardness of the at least one transition layer is optimized based on the hardness of the substrate and/or the working layer. For example, referring to FIG. 2, an insert 200 according to embodiments of the present disclosure is shown, wherein a transition layer 230 is disposed between a working layer 210 and a substrate 220. The transition layer 230 may be designed to have a hardness that is at least 500 HV greater than the hardness of the adjacent substrate 220. Further, the transition layer 230 may be designed to have a hardness that does not exceed the hardness of the adjacent substrate 220 by more than 1500 HV. As shown, the insert 200 has only one transition layer 230, wherein the transition layer 230 is adjacent to both the working layer 210 at a working layer/transition layer interface 215 and the substrate 220 at a transition layer/substrate interface 235. However, according to other embodiments of the present disclosure, an insert may have more than one transition layer. Thus, transition layers of present disclosure may be referred to by the relative location of the transition layer to either the working layer or the substrate. For example, a transition layer interfacing the substrate may be referred to as an inner transition layer, and a transition layer interfacing the working layer may be referred to as an outer transition layer. Further, a transition layer interfacing the substrate and the working layer, such as shown in FIG. 2, may be referred to as either an inner transition layer, an outer transition layer, or as a transition layer (without reference to relative location).

According to embodiments of the present disclosure, an inner transition layer may be engineered to have a hardness value based on the hardness of an adjacent substrate. For example, an inner transition layer may be designed to have a hardness that is at least 500 HV greater than the hardness of an adjacent substrate and that does not exceed the hardness of the adjacent substrate by more than 1500 HV. According to some preferred embodiments, an inner transition layer may have a hardness that is at least 750 HV greater than the hardness of an adjacent substrate and that does not exceed the hardness of the adjacent substrate by more than 1500 HV.

Further, transition layers of the present disclosure may be designed to have a hardness value in the range of 1,900 HV to 3,400 HV. According to some embodiments, a transition layer may be designed to have a hardness value in the range of 2,000 HV to 2,500 HV, while other transition layers may be designed to have a greater hardness value. For example, according to some embodiments, a transition layer adjacent to a substrate may be designed to have a hardness value in the range of 2,000 HV to 2,500 HV, and a transition layer adjacent to an insert working surface may be designed to have a hardness value in the range of 2,500 HV to 3,000 HV.

Figure 3:
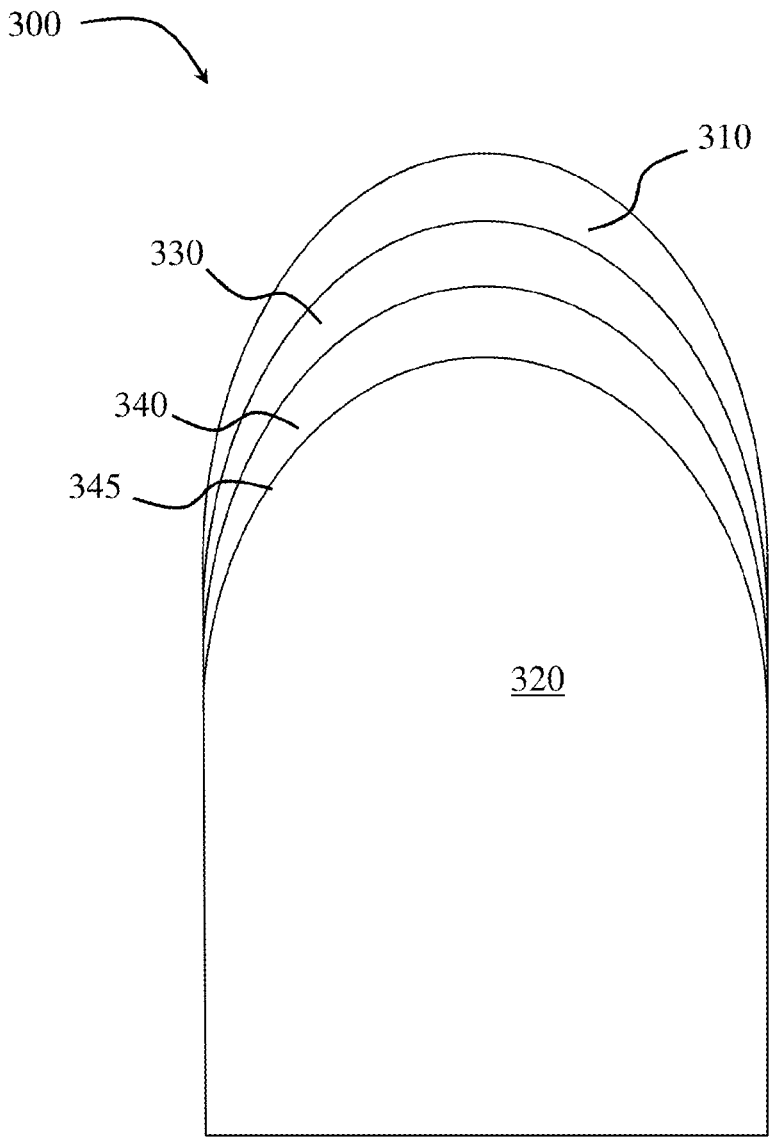
FIG. 3 shows a cross-sectional view of an insert according to embodiments of the present disclosure.

Referring now to FIG. 3, an insert according to embodiments of the present disclosure may have more than one transition layer. As shown, the insert 300 has an working layer 310, a substrate 320, and at least one transition layer 330, 340 between the working layer 310 and the substrate 320. Particularly, an inner transition layer 340 is adjacent to the substrate 320, wherein a transition layer/substrate interface 345 is formed there between. A second transition layer 330 is disposed between the inner transition layer 340 and the working layer 310. As shown, the second transition layer 330 is adjacent to the working layer 310 (and thus may also be referred to as an outer transition layer). However, according to other embodiments, a separate outer transition layer may be disposed between the working layer and the second transition layer, wherein the outer transition layer is adjacent to the working layer.

As discussed above, an insert working layer may be formed of a PCD material, including a plurality of interconnected diamond grains and a binder material. Such working layers may be designed to have a hardness that is equal to or greater than 4,000 HV. However, according to alternative embodiments (described below), a working layer may be designed to have a hardness less than 4,000 HV. A transition layer may be formed of a composite material including a plurality of transition layer diamond grains, a plurality of metal carbide or carbonitride particles, and a transition layer binder material. As mentioned above, such transition layers may be designed to have a hardness ranging from about 1,900 HV to 3,200 HV, depending on the location of the transition layer and the hardness of the insert working layer and/or substrate. Further, a substrate may be made of a metal carbide composite. According to embodiments of the present disclosure, a carbide substrate may have a hardness less than or equal to about 1,600 HV According to embodiments of the present disclosure, an outer transition layer may be engineered to have a hardness value based on the hardness of an adjacent PCD working layer. For example, referring to FIG. 4, an insert may have a PCD working layer 410, a substrate 420, and an outer transition layer 430 between the working layer 410 and the substrate 420, wherein the outer transition layer 430 is adjacent to the working layer 410. The PCD working layer 410 may have a hardness equal to or greater than 4,000 HV (and up to 4500 or 5000 HV), and the outer transition layer 430 may have a hardness that is substantially lower (by at least about 300 HV) than the hardness of the PCD working layer 430. According to embodiments of the present disclosure, an outer transition layer may be designed to have a hardness that is less than the working layer hardness by less than 1500 HV. In some preferred embodiments, the difference between the working layer hardness and the outer transition layer hardness may be designed to be less than 1200 HV. Further, the outer transition layer may be designed to have a hardness that is also between 500 HV and 1500 HV greater than the hardness of the adjacent substrate.

Figure 4:
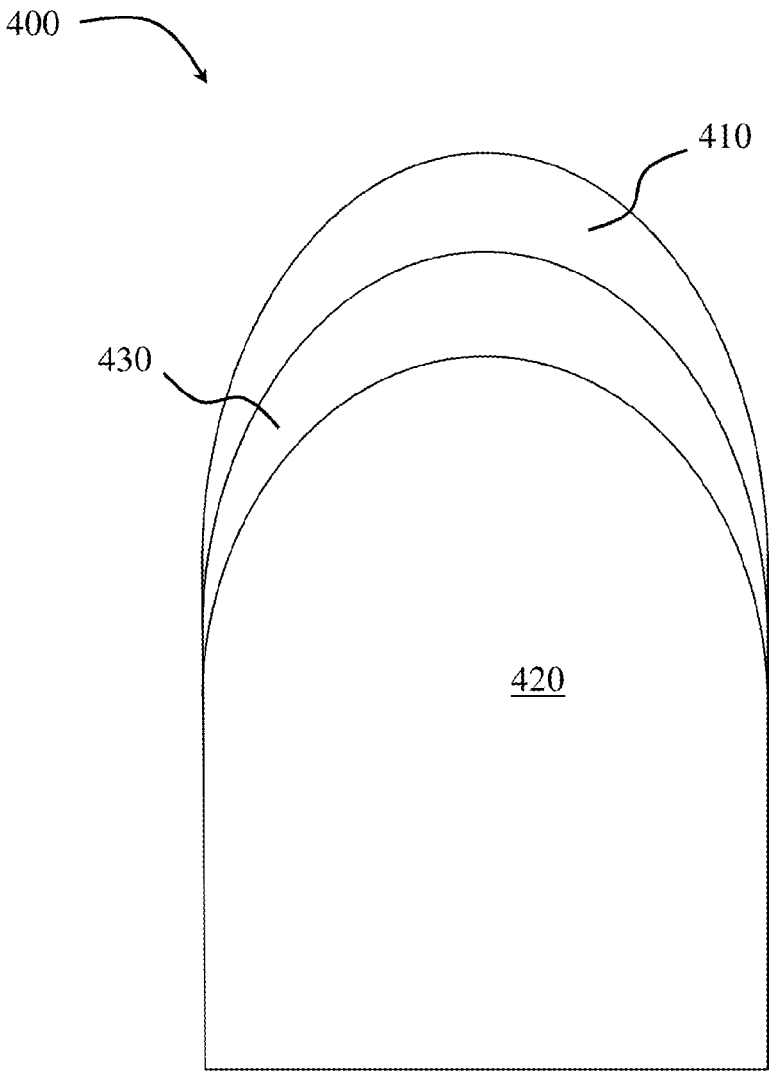
FIG. 4 shows a cross-sectional view of an insert according to embodiments of the present disclosure.

Although the insert shown in FIG. 4 has only one transition layer, inserts of the present disclosure may also have a second (or third) transition layer between the outer transition layer and the substrate. The second transition layer may be adjacent to the substrate, or a separate inner transition layer may be disposed between the second transition layer and the substrate. In embodiments having the second transition layer adjacent to the substrate, the second transition layer may have a hardness that is between 500 HV and 1500 HV greater than the hardness of the substrate. Additionally, in embodiments having an outer transition layer adjacent the working layer and a second transition layer disposed between the outer transition layer and the substrate, the second transition layer may have a hardness in the range of 1900 HV to 3200 HV or 2000 HV to 2500 HV in more particular embodiments.

Furthermore, hardness optimization of transition layers in inserts of the present disclosure may be designed in terms of percentage of a working layer and/or substrate hardness. For example, an insert according to the present disclosure may have at least one transition layer that is designed to have a hardness based on the hardness of the working layer, wherein an outer transition layer has a hardness that is less than the working layer hardness by less than 35%, and preferably less than 30%. According to some embodiments, an insert may have a second transition layer between the outer transition layer and substrate, wherein the second transition layer is adjacent to the substrate. In such embodiments, the second transition layer may be designed to have a hardness that is between 30% and 80% greater than the hardness of the substrate. According to other embodiments, an insert may further include a third transition layer disposed between the outer transition layer and the second transition layer, wherein the third transition layer may be designed to have a hardness that is between 30% and 80% greater than the hardness of the substrate.

According to yet other embodiments, a diamond enhanced insert may have a working layer formed of PCD material having a hardness of less than 4,000 HV (and at least 3200 HV). In such embodiments, an adjacent outer transition layer may be designed to have a hardness that is less than the working layer, wherein the hardness difference between the working layer and the outer transition layer is less than 1,200 HV. According to some preferred embodiments, an insert having a working layer with a hardness of less than 4,000 HV may have an adjacent outer transition layer with a hardness less than the working layer, wherein the hardness difference between the working layer and the outer transition layer is less than 1,000 HV (and at least 300 HV in some embodiments).

Figure 5:
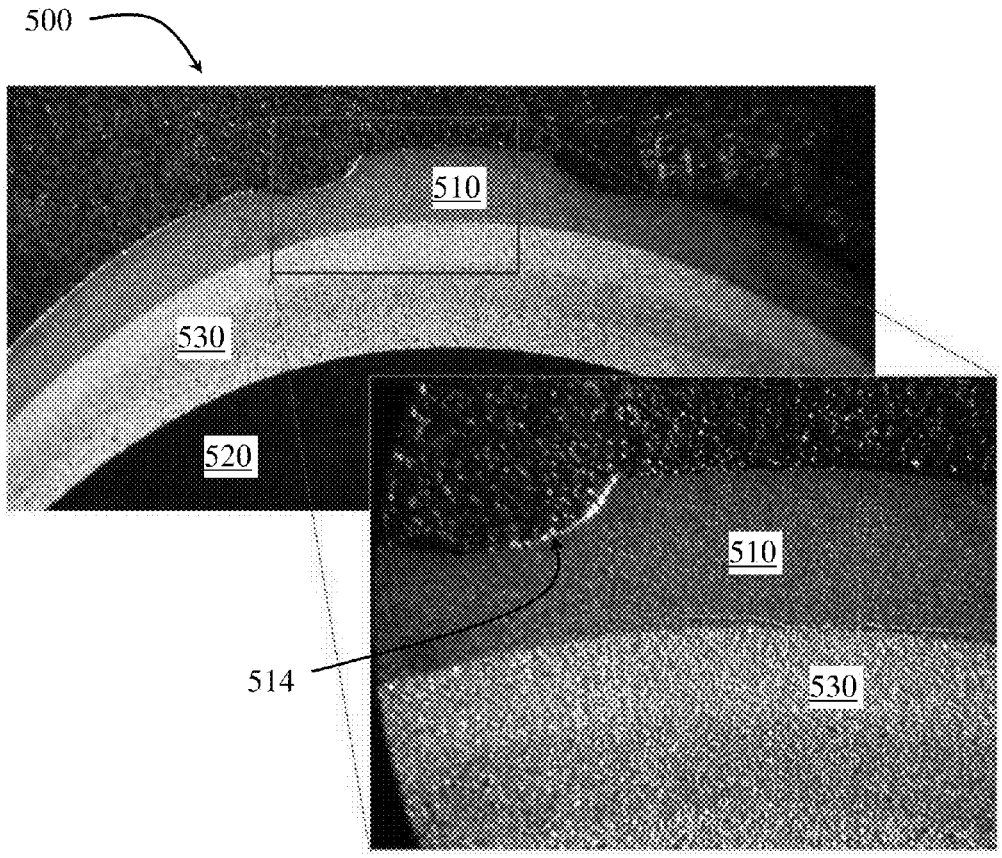
FIG. 5 (Prior Art)
FIG. 5 shows a micrograph of a prior art insert.
Figure 6:
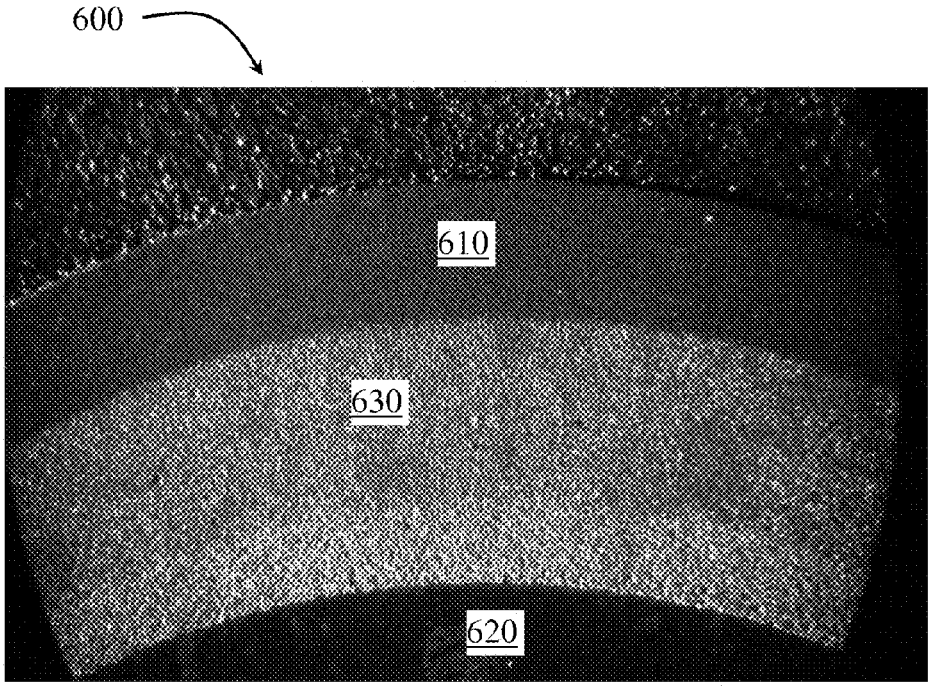
FIG. 6 shows a micrograph of an insert according to embodiments of the present disclosure.

As discussed above, the inventors of the present disclosure have found that by optimizing the hardness difference between adjacent layers of a diamond enhanced insert, the insert may have improved impact resistance when compared to prior art inserts. For example, referring to FIG. 5, a micrograph of a prior art insert having multiple layers is shown, wherein the insert has been exposed to fatigue loading conditions. In particular, the insert 500 has a working layer 510, a substrate 520, and at least one transition layer 530 between the working layer 510 and substrate 520, wherein the hardness difference between the working layer and the adjacent transition layer is greater than 1,500 HV. As shown, the insert 500 failed due to chipping 514 in the working layer 510. However, referring now to FIG. 6, a micrograph of a diamond enhanced insert 600 according to embodiments of the present disclosure is shown, wherein the insert has been exposed to the same fatigue loading conditions as the prior art insert of FIG. 5. The insert 600 has a working layer 610, a substrate 620, and at least one transition layer 630 between the working layer 610 and substrate 620, wherein the hardness difference between the working layer 610 and the adjacent transition layer 630 is less than 1,500 HV. As shown, the insert 600 experienced no chipping or other failure after being exposed to the fatigue loading conditions.

Figure 7:
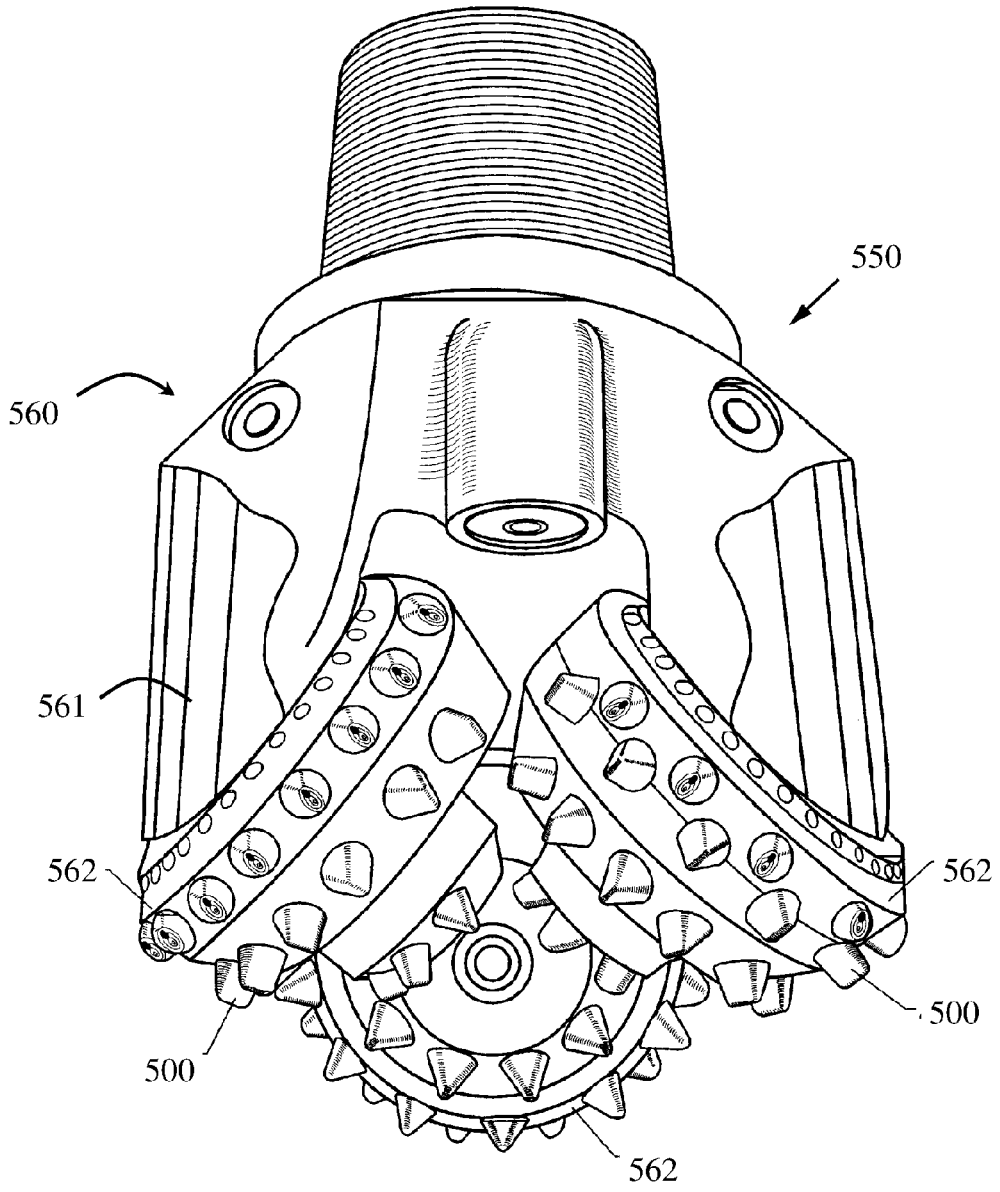
FIG. 7 is a perspective side view of a roller cone drill bit having inserts made according to embodiments of the present disclosure.
Figure 8:
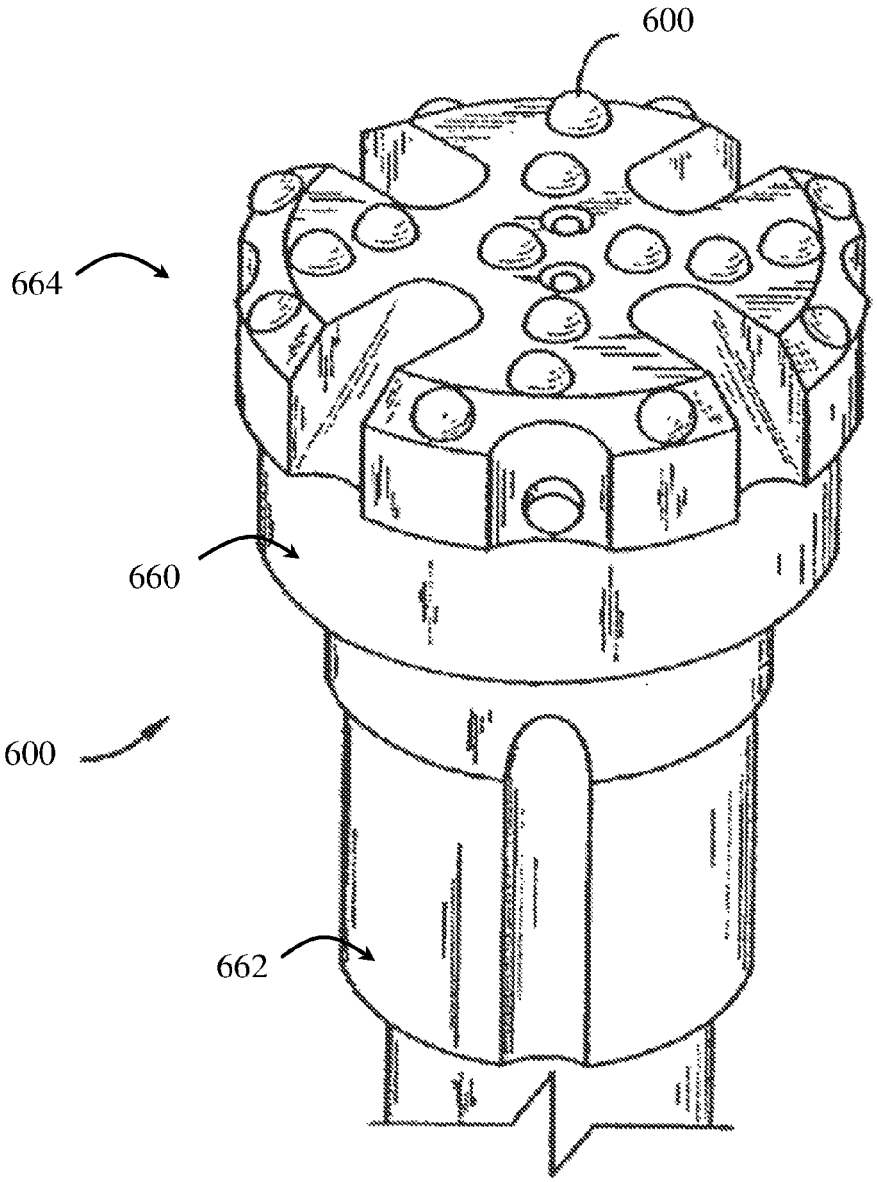
FIG. 8 is a perspective side view of a percussion or hammer bit having inserts made according to embodiments of the present disclosure.

Inserts of the present disclosure may be used with downhole drill bits, such as roller cone drill bits or percussion or hammer drill bits. For example, referring to FIG. 7, inserts 500 of the present disclosure may be mounted to a roller cone drill bit 550. The roller cone drill bit 550 has a body 560 with three legs 561, and a roller cone 562 mounted on a lower end of each leg 561. Inserts 500 according to the present disclosure may be provided in the surfaces of at least one roller cone 562. Referring now to FIG. 7, inserts 600 of the present disclosure may be mounted to a percussion or hammer bit 650. The hammer bit 650 has a hollow steel body 660 with a pin 662 on an end of the body for assembling the bit onto a drill string (not shown) and a head end 664 of the body. A plurality of inserts 600 may be provided in the surface of the head end for bearing on and cutting the formation to be drilled.

The inventors of the present disclosure have advantageously found that when the hardness difference between the working layer and an adjacent transition layer of an insert is within an optimized range disclosed herein, the insert survived higher loading conditions compared to inserts having hardness differences outside the disclosed optimized ranges. For example, prior art inserts having a difference in hardness between the working layer and an adjacent transition layer that exceeded 1,500 HV failed due to chipping and interfacial cracking after certain fatigue loading conditions, whereas inserts engineered according to embodiments of the present disclosure did not fail under the same fatigue loading conditions. Other optimized hardness ranges disclosed herein have also been found to offer the working layer of an insert improved support while at the same time avoiding over-engineering or complex manufacturing processes.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An insert for use with a bit for drilling subterranean formations, the bit comprising a body and a plurality of the inserts disposed thereon, the insert comprising:

a substrate;

a working layer of polycrystalline diamond material on an uppermost end of the insert to contact the subterranean formation during a drilling operation, wherein the polycrystalline diamond material comprises:

a plurality of interconnected diamond grains; and a binder material; and an inner transition layer between the working layer and the substrate, wherein the inner transition layer is adjacent to the substrate and disposed over an entire interfacing surface of the substrate;

wherein the inner transition layer has a hardness that is at least 500 HV greater than the hardness of the substrate, and does not exceed the hardness of the substrate by more than 1500 HV.

2. The insert of claim 1, wherein the hardness of the inner transition layer is at least 750 HV greater than the hardness of the substrate.

3. The insert of claim 1, wherein the hardness of the inner transition layer ranges from 1900 HV to 3400 HV.

4. The insert of claim 1, wherein the hardness of the inner transition layer ranges from 2000 HV to 2500 HV.

5. The insert of claim 1, further comprising a second transition layer between the inner transition layer and the working layer.

6. The insert of claim 1, wherein the substrate has a hardness of less than or equal to about 1600 HV.

7. The insert of claim 1, wherein the inner transition layer is adjacent to the working layer.

8. The insert of claim 1, wherein the inner transition layer comprises:

a plurality of transition layer diamond grains;

a plurality of metal carbide or carbonitride particles; and a transition layer binder material.

9. The insert of claim 1, wherein the substrate comprises a metal carbide composite.

10. The insert of claim 1, wherein the inner transition layer has a hardness in the range of 1800 HV to 2500 HV.

11. A drill bit, comprising:

a bit body; and at least one insert of claim 1 disposed on the drill bit.

12. The drill bit of claim 11, further comprising at least one roller cone mounted on the bit body, where the at least one insert is disposed on the roller cone.

13. An insert for a bit used for drilling subterranean formations, the bit comprising a body having a plurality of the inserts operatively attached thereto to contact the subterranean formation, the insert comprising:

a substrate;

a working layer of sintered polycrystalline diamond material on the uppermost end of the insert for contacting the subterranean formation during a drilling operation, wherein the polycrystalline diamond material is formed during high pressure/high temperature conditions and comprises:

a plurality of interconnected diamond grains; and a binder material; and an outer transition layer between the working layer and the substrate, wherein the outer transition layer is adjacent to the working layer;

an inner transition layer interposed between the outer transition layer and the substrate;

wherein the working layer has a hardness greater than or equal to 4000 HV;

wherein the outer transition layer has a hardness that is between 300 HV to 1500 HV less than the working layer hardness; and wherein the inner transition layer has a hardness that is at least 500 HV greater than the hardness of the substrate, and that does not exceed the hardness of the substrate by more than 1500 HV.

14. The insert of claim 13, wherein the difference between the working layer hardness and the outer transition layer hardness is less than 1200 HV.

15. The insert of claim 13, wherein the outer transition layer comprises:

a plurality of transition layer diamond grains;

a plurality of metal carbide or carbonitride particles; and a transition layer binder material.

16. The insert of claim 13, wherein the substrate has a hardness of less than or equal to about 1600 HV.

17. An insert for a bit used to drill subterranean formations, comprising:

a substrate;

a working layer of polycrystalline diamond material on the uppermost end of the insert for engaging the subterranean formation during a drilling operation, wherein the polycrystalline diamond material comprises:

a plurality of interconnected diamond grains; and a binder material; and an transition layer interposed between and in contact with both the working layer and the substrate, wherein the transition layer covers the entire surface of the substrate;

wherein the transition layer has a hardness that is at least 500 HV greater than the substrate and that does not exceed the hardness of the substrate by more than 1500 HV.

18. The insert of claim 17, wherein the working layer has a hardness of less than about 4000 HV.

19. The insert of claim 17, wherein the working layer has a hardness of greater than about 4000 HV.

20. The insert of claim 19, wherein the transition layer has a hardness between about 1900 to 3200 HV.

21. The insert of claim 17, wherein the transition layer has a hardness that is less that the hardness of the working layer by less than 1500 HV.

22. The insert of claim 17, wherein the substrate has a hardness that is less than or equal to about 1600 HV.

* * * * *